US007370408B2

(12) United States Patent
Deming et al.

(10) Patent No.: US 7,370,408 B2
(45) Date of Patent: May 13, 2008

(54) HOLD DOWN DEVICE IN A TERMINAL APPLICATOR

(75) Inventors: Neil Edward Deming, Lewisberry, PA (US); David Joseph Erb, Harrisburg, PA (US); Trevis Lee Benchoff, Waynesboro, PA (US)

(73) Assignee: Tyco Electronics Corporation, Middletown, PA (US)

( * ) Notice: Subject to any disclaimer, the term of this patent is extended or adjusted under 35 U.S.C. 154(b) by 111 days.

(21) Appl. No.: 11/363,113

(22) Filed: Feb. 27, 2006

(65) Prior Publication Data

US 2007/0245550 A1 Oct. 25, 2007

(51) Int. Cl.
*H01R 43/027* (2006.01)

(52) U.S. Cl. ..... 29/753; 29/33 M; 29/747; 29/748; 72/446

(58) Field of Classification Search ..... 29/753, 29/751, 760, 747, 748, 857, 867, 33 M; 72/712, 72/20.1, 20.2, 22.4, 412–416, 441–444
See application file for complete search history.

(56) References Cited

U.S. PATENT DOCUMENTS 4,216,668 A * 8/1980 Walton, II ..... 72/412
4,290,179 A * 9/1981 Bakermans et al. ..... 29/33 M
5,577,318 A * 11/1996 Smith et al. ..... 29/753
6,102,276 A * 8/2000 Takada ..... 228/235.1
6,513,695 B2 * 2/2003 Yamakawa ..... 228/3.1

* cited by examiner

*Primary Examiner*—Terrence R. Tlil
*Assistant Examiner*—Jossef Zilberman

(57) ABSTRACT

A terminal applicator (50) for attaching electrical terminals (52) to a wire includes a terminal hold down device (90) for limiting movement of the terminal during the crimping process. The hold down device (90) includes a hold down arm (92), a pair of guide rods (102), and a removable standoff (130). The guide rods (102) are carried by a reciprocating ram (68) and are arranged so that when the standoff abuts a travel limit block (148) the hold down arm remains in close proximity to the terminal while the ram (68) continues its motion to complete the crimping cycle.

20 Claims, 10 Drawing Sheets

HOLD DOWN DEVICE IN A TERMINAL APPLICATOR

The present invention relates to an applicator machine for attaching an electrical terminal to a wire by means of a crimping process and more particularly to an applicator having a hold down device, carried by a ram of the applicator for limiting movement of and preventing deforming of the terminal during the crimping process.

BACKGROUND OF THE INVENTION

Terminal applicator machines are widely used in the industry to attach electrical terminals to conductors. These terminal applicators are typically secured in a press which supplies the power and motion that operates the applicator. The applicator may be used manually where an operator inserts an already prepared wire end into the crimping area between a crimping tool and an anvil containing a terminal and holds the wire in place while activating the press to complete the termination. Alternatively, the terminal applicator and associated press may be attached to a host machine, such as a lead maker, where the prepared wire end is automatically presented to the applicator tooling for termination. These terminal applicators typically feed a strip of terminals along a guide rail into a workstation where one of the terminals is positioned over an anvil. The wire, its end having been previously stripped of insulation, is positioned in the workstation and the apparatus is activated to cause crimping tools to engage and crimp the tabs of the terminal onto the end of the wire. There are two variations of terminal feeding arrangements, depending on the arrangement of the terminals on their carrier strip. Carrier strips can be designed for either side feed or end feed in conformance with the configuration of the terminal. Each presents its own unique characteristics when considering the design of a terminal hold down for controlling and limiting movement of the terminal during the actual crimping of the terminal onto the wire.

An example of a prior art terminal hold down for an end feed application is shown in FIG. 1. There a partial view is shown of a ram 2 of a terminal applicator having terminal crimping tooling 4 and a terminal hold down 6, both of which are carried by the ram during the crimping process. The hold down 6 is in sliding engagement with an opening 8 formed in the ram 2 so that the hold down is free to undergo limited movement in the directions indicated by the arrows 10 and 12. An elastic member, not shown, is positioned within the opening 8 so that it urges the hold down 6 in the direction of the arrow 12. The hold down 6 includes a terminal hold down surface 14 and a projection 16 having a stop surface 18 spaced from the surface 14 a specific amount. This spacing is chosen so that, when the ram 2 has reached the end of its stroke and the tooling 4 is in crimping engagement with a terminal, the stop surface 18 has engaged a fixed surface, not shown, and the hold down surface 14 is in a desired close proximity to the terminal for limiting adverse movement of the terminal. This type hold down 6 must necessarily have the projection 16 and stop surface 18 accurately machined so that the spacing of the surface 18 from the surface 14 corresponds to the requirements of the terminal being crimped. Every terminal having different spacing requirements necessitates a hold down 6 with a unique spacing of the surface 18 from the surface 14. This results in many different, relatively complex, hold downs being manufactured and maintained and, of course, their corresponding substantial cost.

An example of a prior art terminal hold down for a side feed application is shown in FIG. 2. There a partial view is shown of a ram 24 of a terminal applicator having terminal crimping tooling 26 and a terminal hold down 28, both of which are carried by the ram during the crimping process. The hold down 28 has a hold down surface 30 and is constructed of a urethane and includes a stud 32 that is threaded into a hole in a member 34 attached to the ram 24 and a lock nut 36 arranged to lock the stud in a desired position. The hold down 28 is positioned so that when the ram 24 has reached the end of its stroke and the tooling 26 is in crimping engagement with a terminal, the hold down surface 30 is in a desired close proximity to the terminal for limiting adverse movement of the terminal. This arrangement requires that the hold down 28 be positioned very accurately so that the terminal is not damaged when the ram 24 is fully extended during crimping. The urethane material provides a slightly pliable surface to aid in preventing damage of the terminal should an out of tolerance condition be encountered. This material, however, has the disadvantage of becoming warn during use, requiring occasional replacement. Another disadvantage is that each time the crimp height is adjusted, the position of the hold down 28 must be readjusted. This can be a tedious operation during initial set up of the applicator.

What is needed is a terminal applicator machine having a simple and inexpensive terminal hold down device that will work for a wide range of different terminal sizes, in both end feed and side feed application, and that need not be readjusted upon adjusting the crimp height of the applicator.

SUMMARY OF THE INVENTION

A terminal applicator is provided for attaching an electrical terminal to a conductor. The terminal applicator includes a frame and an anvil supported by the frame that is arranged to receive an electrical terminal. A ram, having crimping tooling attached thereto, is in sliding engagement with the frame and is arranged to undergo reciprocating motion carrying the crimping tooling along an axis in a crimping direction into crimping engagement with the electrical terminal and in an opposite return direction away from the terminal. The crimping tooling forms the crimp in cooperation with the anvil. A hold down device carried by the ram is provided for moving into close proximity to the terminal when the crimping tooling is approaching engagement with the terminal to minimize adverse movement and deformation of the terminal during the crimping operation. The hold down device includes a standoff removably attached thereto that engages the abutting surface when the crimping tooling is approaching engagement with the terminal thereby preventing pressing contact between the hold down device and the terminal during approaching crimping engagement and crimping of the terminal.

An embodiment of the invention will now be described by way of example with reference to the following drawings.

DESCRIPTION OF AN EMBODIMENT OF THE INVENTION

Figure 1:
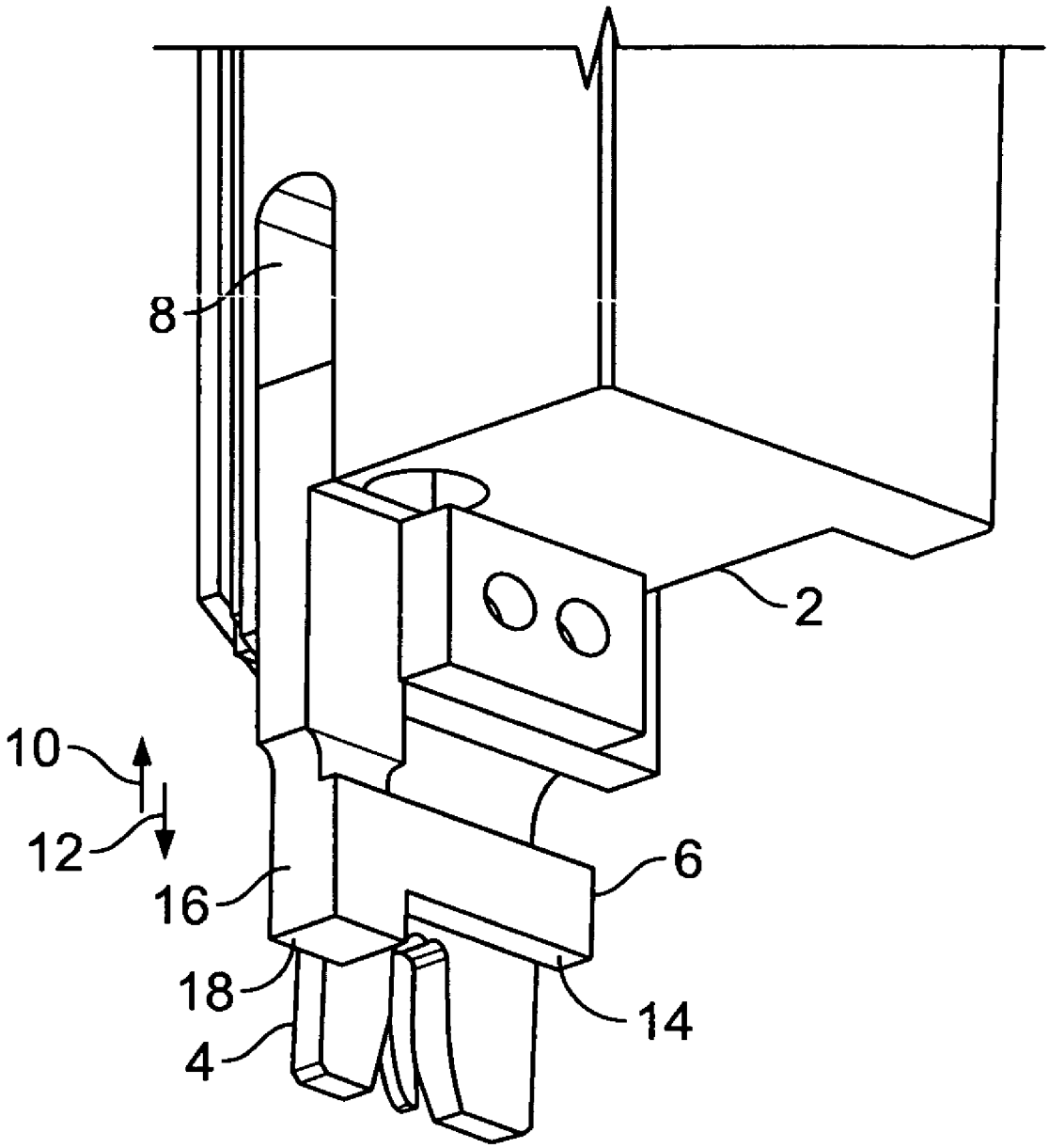
FIG. 1 (Prior Art)
FIG. 1 is an isometric view of a portion of a terminal applicator ram showing a prior art terminal hold down device for end feed applications.
Figure 2:
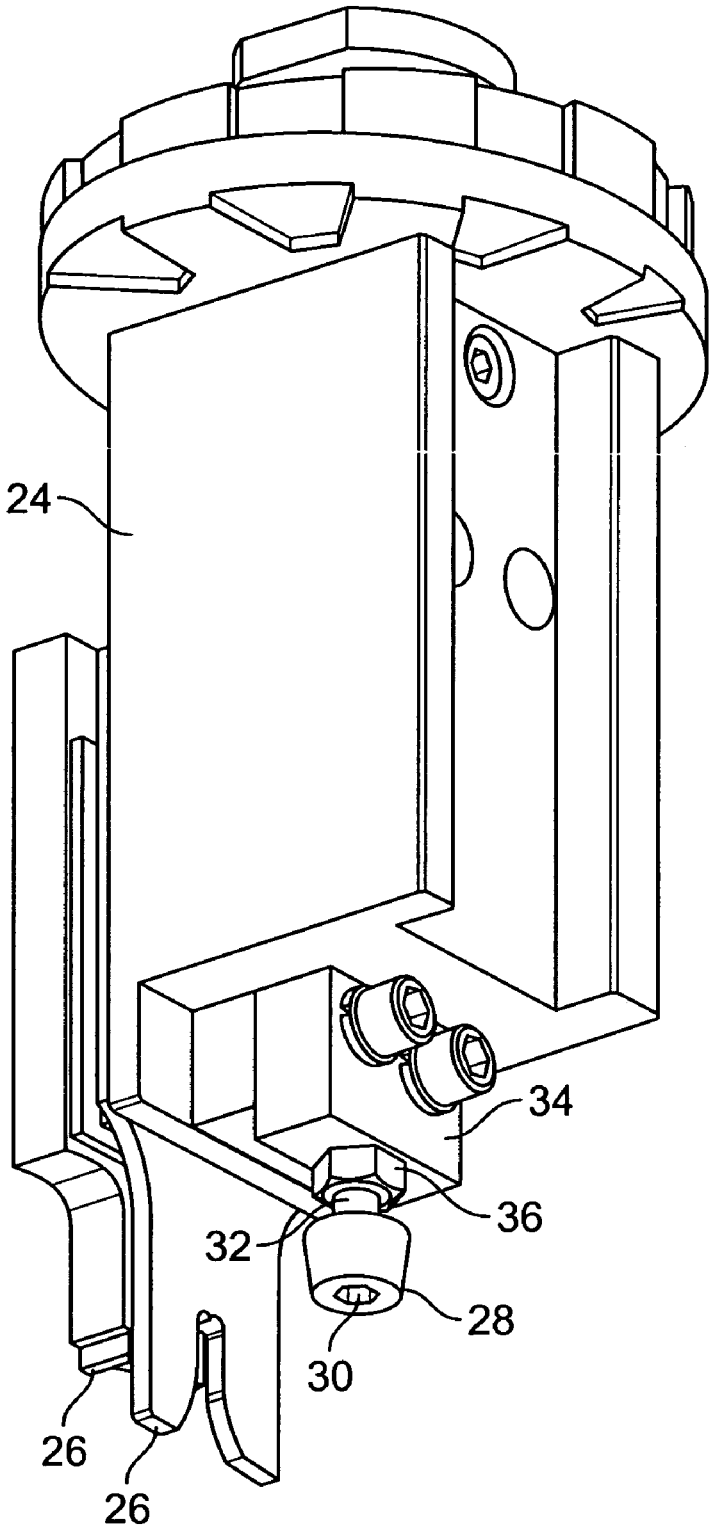
FIG. 2 (Prior Art)
FIG. 2 is an isometric view of a portion of a terminal applicator ram showing a prior art terminal hold down device for side feed applications.
Figure 3:
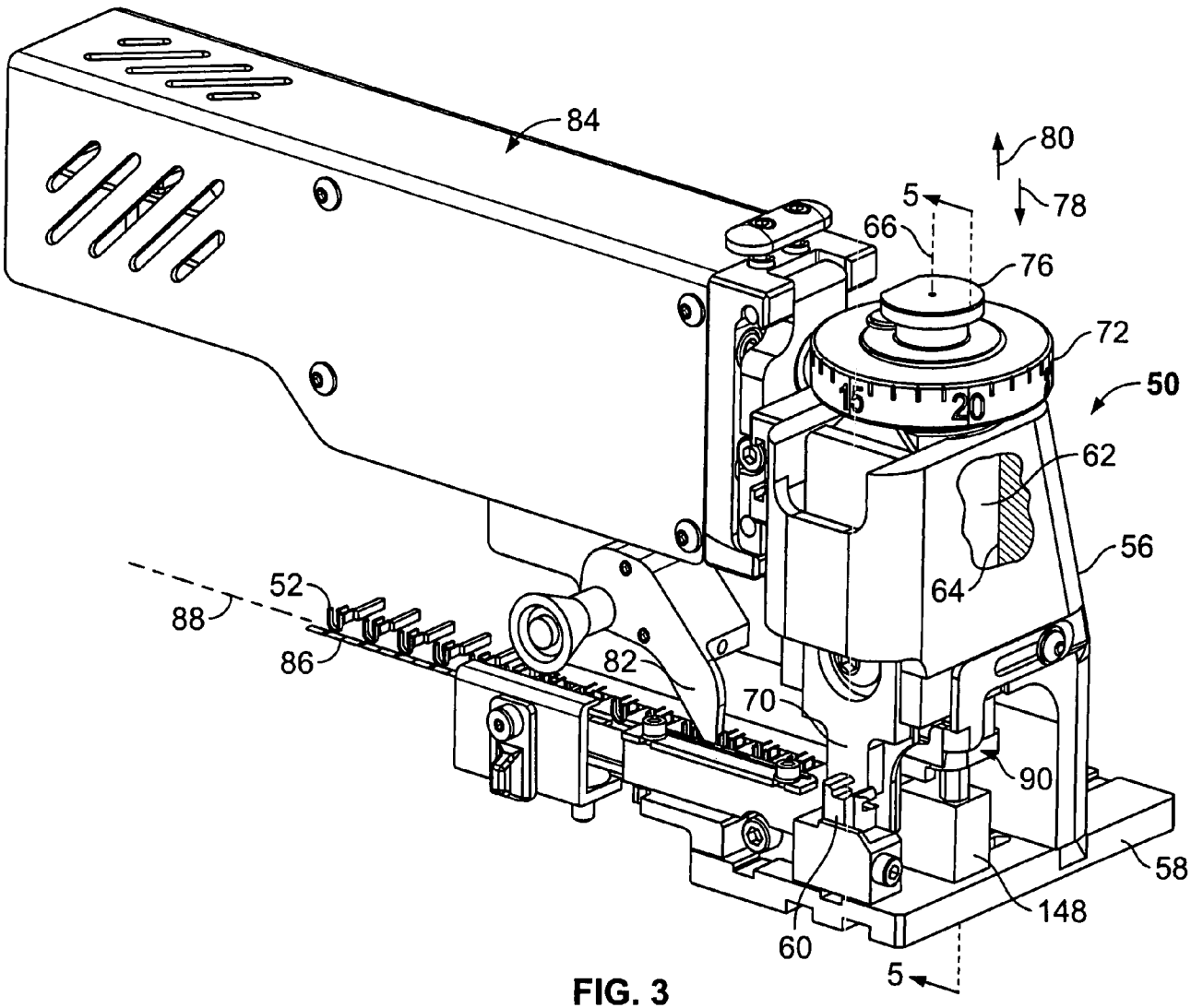
FIG. 3 is an isometric view of a terminal applicator incorporating the teachings of the present invention, showing a feed mechanism for side feeding a strip of terminals.
Figure 4:
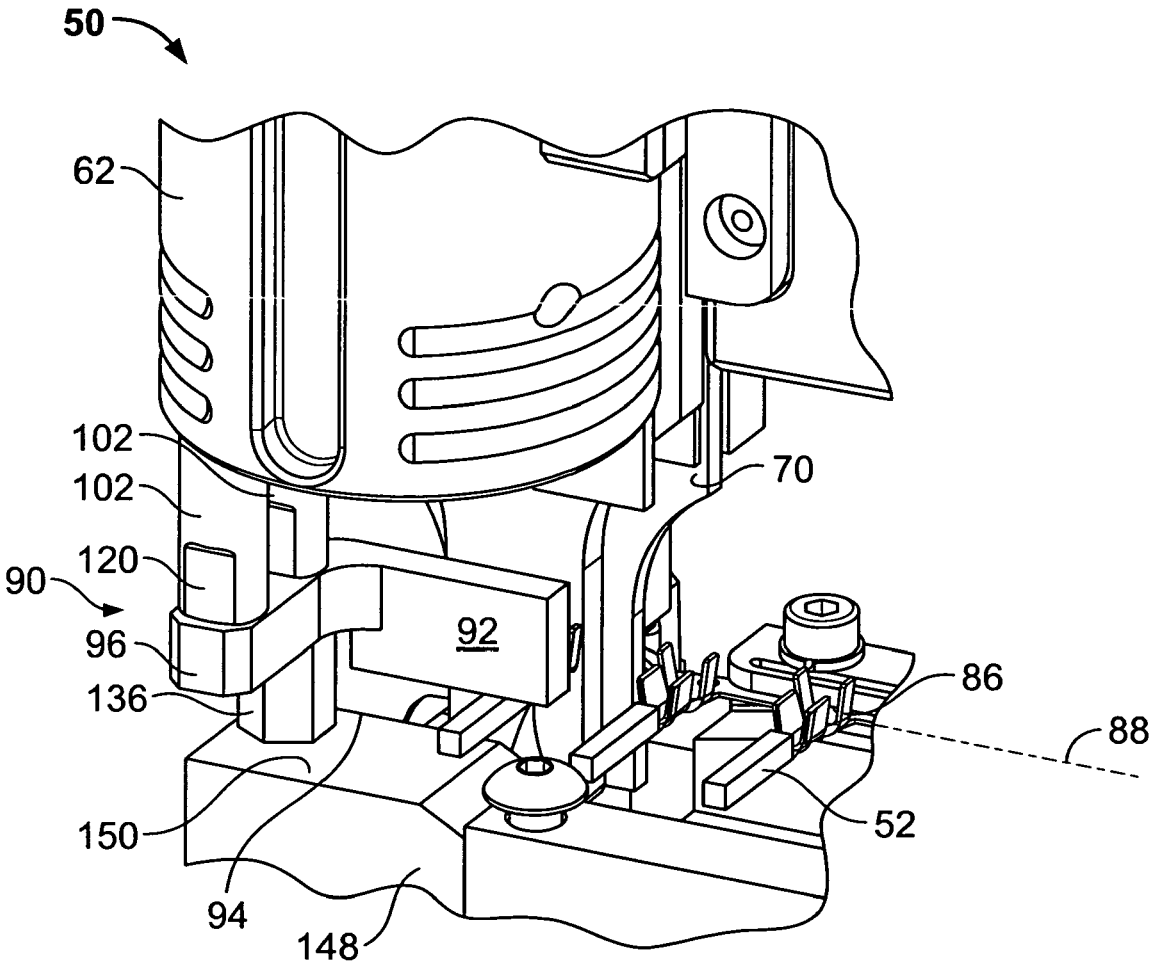
FIG. 4 is an enlarged partial rear view of the terminal applicator in FIG. 3 showing the ram, terminal hold down device, and a strip of terminals.
Figure 5:
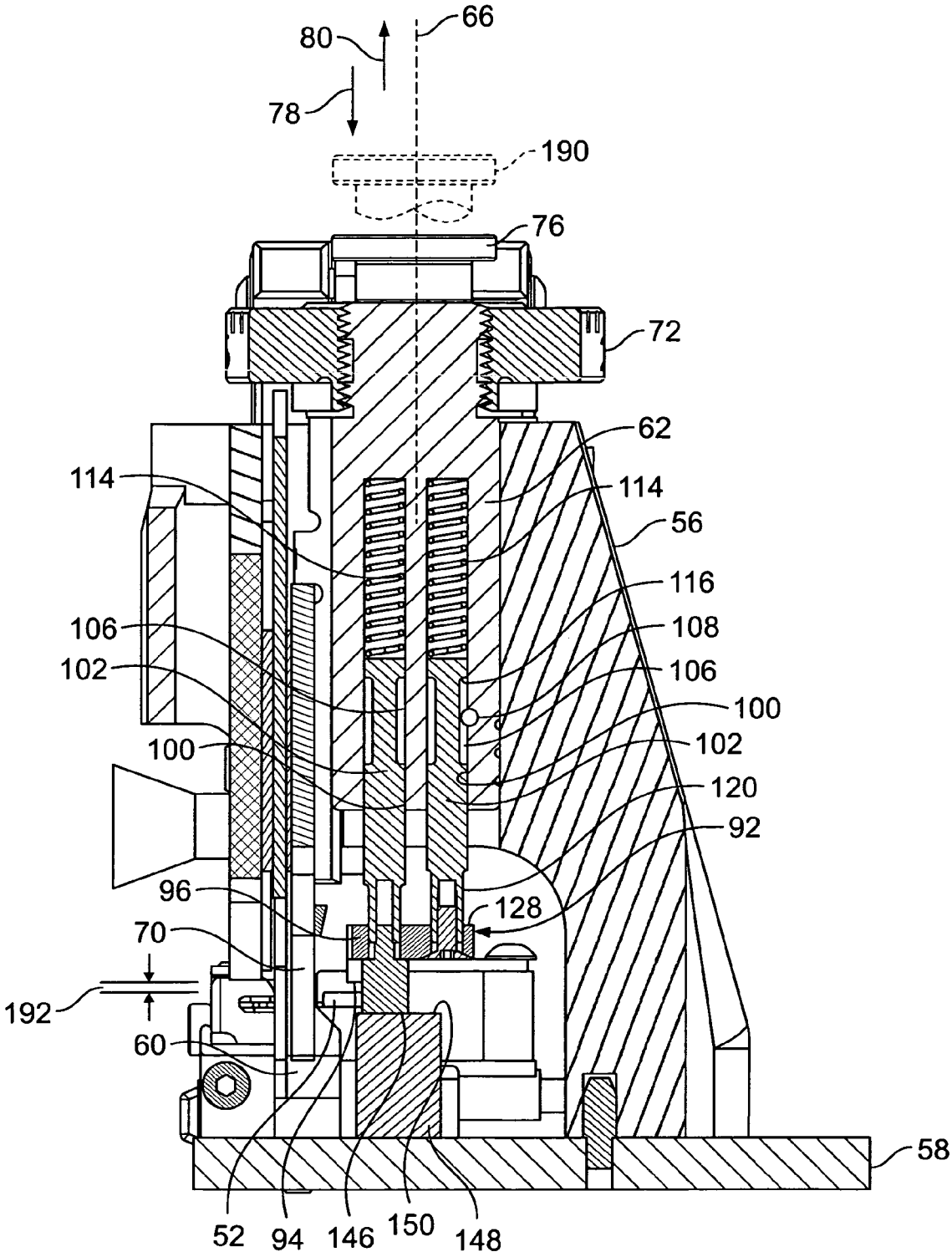
FIG. 5 is a cross sectional view taken along the lines 5-5 in FIG. 3 showing a terminal hold down device and its coupling to the ram.

There is shown in FIG. 3 a terminal applicator 50 for crimping an electrical terminal 52 onto a wire (not shown). The applicator includes a frame 56, base 58 that supports an anvil 60, and a ram 62 that is in sliding engagement within an opening 64 in the frame, and is arranged to undergo reciprocating movement in a crimping direction 78 toward the anvil and away therefrom in a return direction 80 along a vertical axis of movement 66. The ram 62, as best seen in FIGS. 4 and 5, comprises a ram 62 which carries crimping tooling 70 attached to the ram in the usual manner. An insulation crimp height adjust mechanism 72 is coupled to the ram 62 by means of internal screw threads on the mechanism 72 and external screw threads on the ram 62. The wire crimp height is adjusted be means of a stepper motor and lead screw in the applicator 50, not shown. The wire crimp height adjustment described above is by way of example and may be effected by means other than a stepper motor and lead screw, as will be understood and known by those skilled in the art. The ram 62 includes a coupling head 76 that couples the ram 62 to a press ram of a host machine, not shown. When the press ram of the host machine is actuated, it imparts reciprocating motion to the ram 62. A terminal feed mechanism 84 is coupled to the frame 56 and is electronically controlled by a program in a motion controller, not shown, to incrementally feed a strip 86 of terminals 52 along a feed path 88, in the usual manner, so that a new terminal 52 is positioned on the anvil 60 for each crimping cycle. This process will be described more fully below. There is no mechanical connection between the applicator ram 62 and the feed mechanism 84. The feed mechanism is mounted to the applicator frame 56 via a quick-disconnect device, not shown, and connected to a motion controller, not shown, in the host machine via a cable, not shown. The timing between the stroke of the ram and the position of a feed finger 82 is controlled by a program in the motion controller in the host machine. While the feed mechanism 84, as described above, is not mechanically connected to the ram, it will be understood that the teachings of the present invention can be advantageously utilized in an applicator having a more conventional feed mechanism that is physically coupled to the ram for controlling the timing between the stroke of the ram and the position of a feed finger. The application of the present terminal hold down device 90 is independent of the type of terminal feed mechanism utilized. This independence applies, as well, to all variations of the invention as set forth below.

Figure 6:
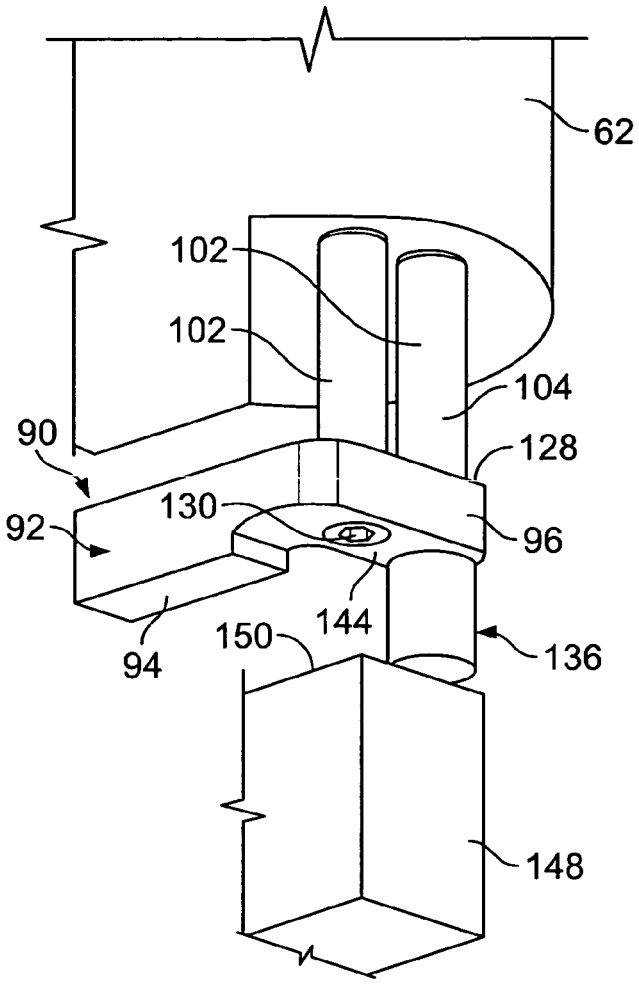
FIG. 6 is an isometric view of the terminal hold down mechanism and a portion of the ram shown in FIG. 3.
Figure 7:
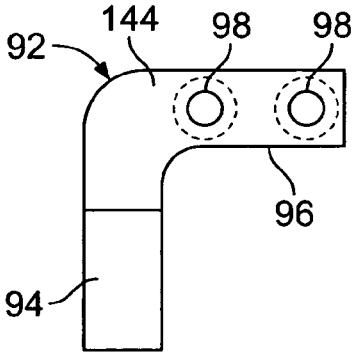
FIG. 7 is a plan view of the hold down arm shown in FIG. 6.
Figure 8:
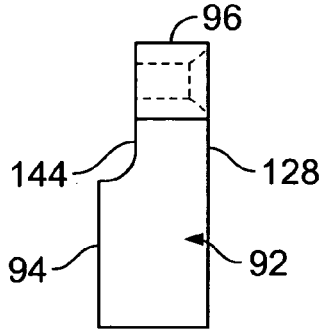
FIG. 8 is a side view of the hold down arm shown in FIG. 7.
Figure 9:
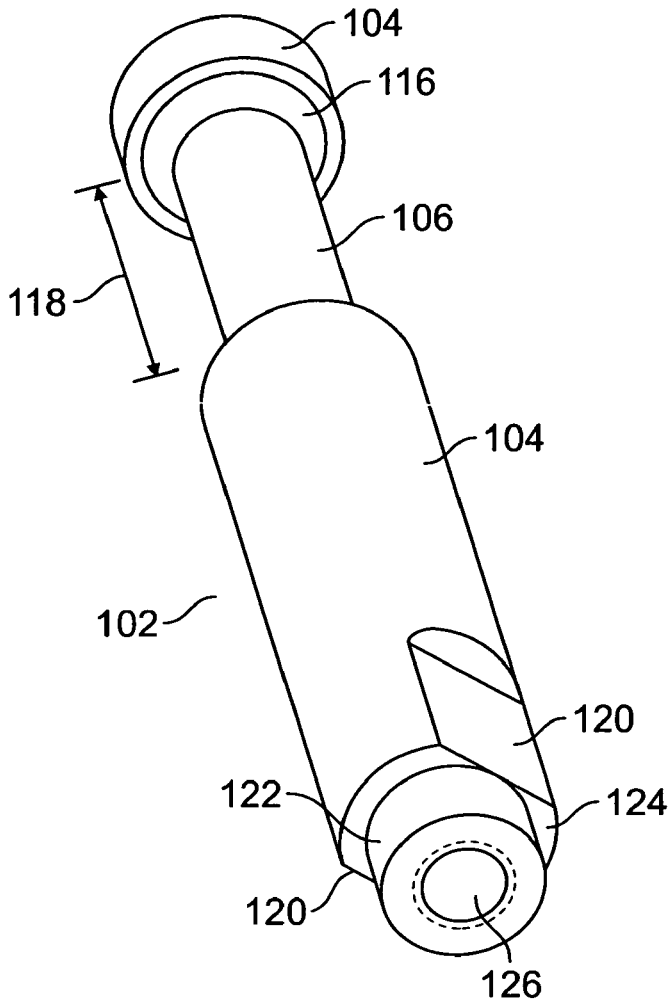
FIG. 9 is an isometric view of a guide rod as shown in FIG. 6.
Figure 10:
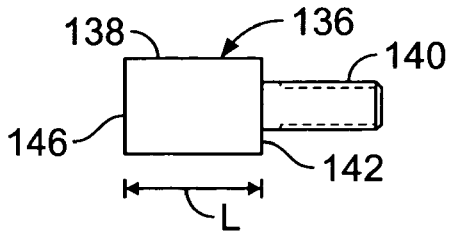
FIG. 10 is a side view of a standoff shown in FIG. 6.
Figure 11:
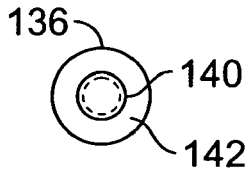
FIG. 11 is an end view of the standoff shown in FIG. 10.

A terminal hold down device 90 is coupled to the ram 62 as best seen in FIGS. 3 through 6. The hold down device 90 includes a hold down arm 92 having a hold down surface 94 and an offset mounting flange 96. Two countersunk holes 98 are formed in the flange 96, as best seen in FIGS. 7 and 8, and are spaced to correspond with two holes 100 bored in the ram 62 parallel to the vertical axis 66, as shown in FIG. 5. Two guide rods 102, shown in FIGS. 5 and 9, each includes an outer diameter 104 that is a sliding fit with the holes 100 in the rain 62. The two guide rods are arranged in the holes 100 as shown. A reduced diameter 106 is formed in the outer diameter 104 for receiving a keeper pin 108 that is in a press fit hole in the ram 62. Each hole 100 has a compression spring 114 arranged to urge its corresponding guide rod 102 in a downward direction parallel to the axis 66, as viewed in FIG. 5. The keeper pin 108 prevents the guide rods 102 from extending too far downwardly by engaging a shoulder 116 of one of the guide rods when the ram 62 is at the top of its stroke. The length 118 of the reduced diameter 106, as shown in FIG. 9, allows sufficient movement of the guide rods 102 so that the terminal hold down arm 92 can be brought into close proximity to the terminal 52 before the crimping tooling actually engages the terminal, as will be described in more detail below. Each guide rod 102 includes two wrench flats 120 and a reduced diameter 122 extending from a shoulder 124, as best seen in FIG. 9. A threaded hole 126 is formed axially in the reduced diameter end of each guide rod 102. The reduced diameters 122 of the two guide rods are sized to be slidingly received in the two holes 98 in the flange 96. As best seen in FIGS. 5 and 6, the hold down arm 92 is positioned as shown with the reduced diameters 122 of the two guide rods in their respective holes 98 and an upper surface 128 of the flange 96 being against the shoulders 124. A flat head screw 130 is extended through one of the countersunk holes 98 and into threaded engagement with one of the holes 126 in a respective guide rod. A standoff 136, shown in FIGS. 6, 10, and 11, has an outer surface 138 that may be cylindrical shaped, as is shown in FIG. 10, hexagonal as shown in FIG. 4, or some other shape that provides wrench flats for easy removal and installation. The cylindrical portion of the standoff 136 has a length L that may vary to correspond to a particular terminal being applied by the applicator 50, as will be explained in more detail below. A threaded end or stud 140 extends from a shoulder 142 and is sized to thread into either of the threaded holes 126 of the guide rods 102 so that the standoff 136 is removable. During operation, as best seen in FIGS. 4, 5, and 6, the stud 140 is tightly threaded into the hole 126 not occupied by the flat head screw 130 so that the shoulder 142 presses against a lower surface 144 of the flange 96, thereby urging the upper surface 128 thereof into tight pressing engagement with the shoulder 124 of the guide rod. The standoff 136 includes a stop surface 146 on an end opposite the stud 140. A travel limit block 148, attached to the base 58, has an abutting surface 150 facing upwardly, as viewed in FIG. 5, and in alignment with the standoff 136 so that when the ram 62 moves downwardly the stop surface will engage the abutting surface.

Figure 12:
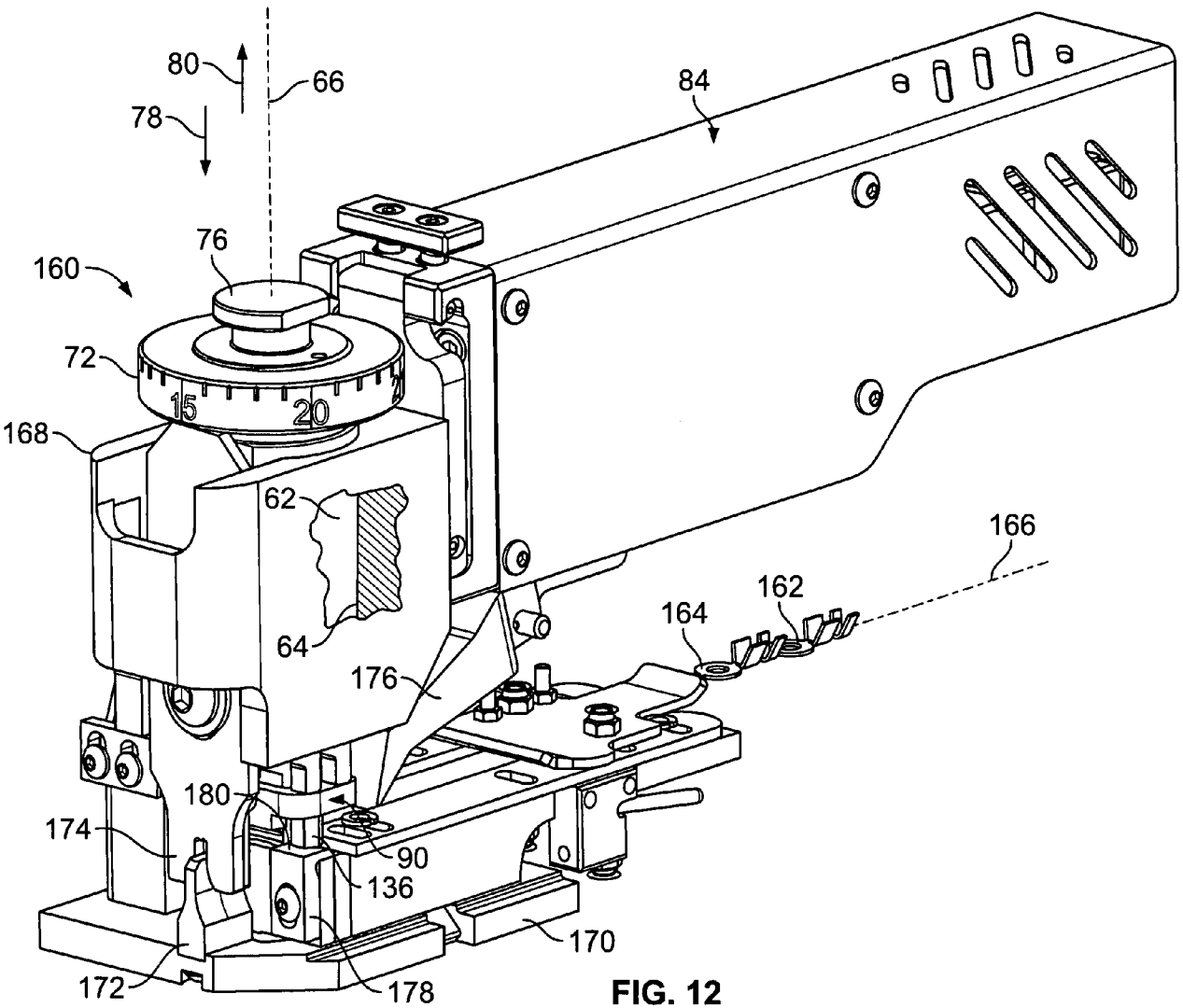
FIG. 12 is an isometric view similar to that of FIG. 3 showing a feed mechanism for end feeding a strip of terminals.
Figure 13:
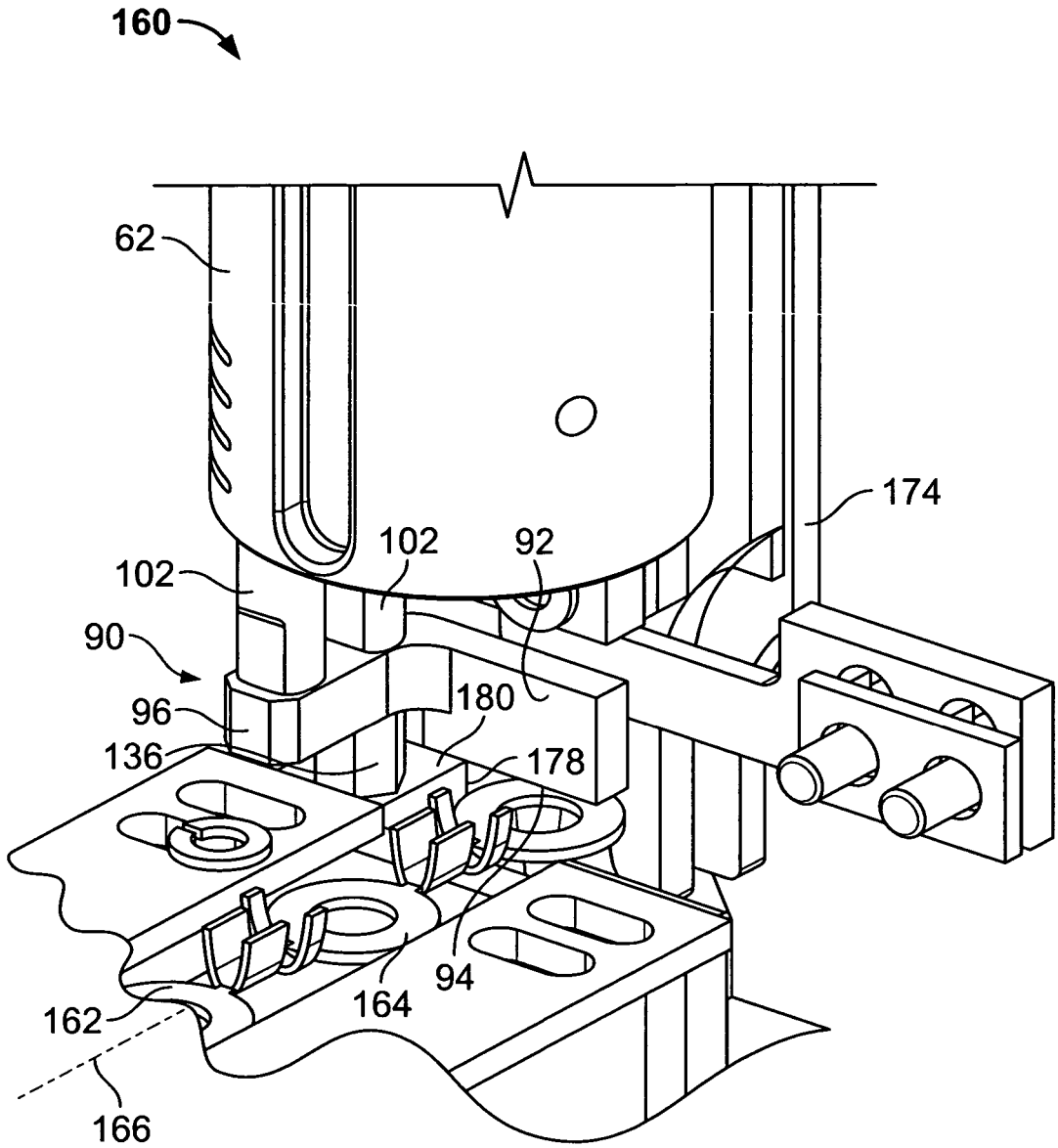
FIG. 13 is an enlarged partial rear view of the terminal applicator of FIG. 12, similar to that of FIG. 4, showing the ram, terminal hold down device, and a strip of terminals.

There is shown in FIG. 12 a terminal applicator 160 similar to the terminal applicator 50, but arranged for end feed of a strip 162 of terminals 164 along a feed path 166. The applicator 160 will be briefly described with respect to its differences to applicator 50. Similar parts that are substantially interchangeable between the two applicators will be referenced by the same part numbers. The applicator 160 includes a frame 168, base 170 that supports an anvil 172, and a ram 62 that is in sliding engagement within an opening 64 in the frame, and is arranged to undergo reciprocating movement in a crimping direction 78 toward the anvil and a return direction 80 away therefrom along a vertical axis of movement 66. The ram 62, as best seen in FIG. 13, comprises a ram 62 which carries crimping tooling 174 attached to the ram in the usual manner. An insulation crimp height adjust mechanism 72, shown in FIG. 12, is coupled to the ram 62 in a manner similar to that in the applicator 50 by means of internal screw threads on the mechanism 72 and external screw threads on the ram 62. A shoulder coupling head 76, a part of the ram 62, permits coupling to a host machine for operation, as described above. A terminal feed mechanism 84 is coupled to the frame 168 and is electronically actuated by a motion controller in the host machine in a manner similar to that of the applicator 50, that indicates actual motion of the ram 62 to incrementally feed the strip 162 of terminals 164 along the feed path 166, in the usual manner, so that a new terminal 164 is positioned on the anvil 172 for each crimping cycle. As with the applicator 50, there is no mechanical connection between the applicator ram 62 and the feed mechanism 84. The feed mechanism is mounted to the applicator frame 168 via a quick-disconnect device, not shown, and connected to a motion controller, not shown, in the host machine via a cable, not shown. The timing between the stroke of the ram and the position of a feed finger 176 is controlled by a program in the motion controller in the host machine. The terminal hold down device 90, as shown in FIG. 13, includes the hold down arm 92 having the hold down surface 94 and the offset mounting flange 96, as described above for the applicator 50. The hold down arm 92 is coupled to the applicator 160 by means of the guide rods 102, screw 130, springs 114, keeper pin 108, and stand off 136, in a manner similar to that of the applicator 50. The length 118 of the reduced diameter 106, as shown in FIG. 9, allows sufficient movement of the guide rods 102 so that the terminal hold down arm 92 can be brought into close proximity to the terminal 164, as shown in FIGS. 12 and 13, before the crimping tooling actually engages the terminal, as will be described in more detail below. A travel limit block 178, attached to the frame 168, has an abutting surface 180 facing upwardly, as viewed in FIG. 13, and in alignment with the standoff 136 so that when the ram 62 moves downwardly the stop surface will engage the abutting surface in a manner similar to that of the applicator 50.

In operation of the applicator 50, as best seen in FIG. 5, the ram 62 undergoes reciprocating motion between an upward limit indicated in phantom lines at 190 and a downward limit as shown in solid lines. Starting at this upward limit the two guide rods 102 will be extended downwardly so that the shoulder 116 is against the keeper pin 108, and the stop surface 146 of the standoff 136 is spaced well above the travel limit block 148. As the ram 62 moves downwardly along the axis 66 in the crimping direction 78 toward the base 58, carrying the hold down arm 92, the standoff approaches the travel limit block 148 and finally the stop surface 146 engages the abutting surface 150 thereby preventing further downward movement of the hold down arm, as seen in FIG. 5. At this point of the downward movement of the ram 62, the crimping tooling 70 is approaching crimping engagement with the terminal 52 and the hold down surface 94 of the hold down arm is in very close proximity to the terminal 52 without actually touching it. The distance, or gap, indicated at 192 of FIG. 5, between the hold down surface 94 and the upper surface of the terminal 52 is preferably between about 0.005 inch and about 0.010 inch but may vary between 0.000 inch and as much as about 0.060 depending upon the specific terminal application. During operation the terminal may deform and close that gap to actually touch the hold down surface. As downward movement of the ram 62 continues to its downward limit, shown in solid lines in FIG. 5, the crimping tooling 70, in cooperation with the anvil 60, crimpingly engages the terminal 52 and crimps it to a conductor, not shown. During this continued downward movement of the ram and final crimping of the terminal the two springs 114 compress as the two guide rods 102 move upwardly in their respective holes 100 so that the hold down surface 94 maintains the gap 192. In this way the hold down device 90 is effective in limiting adverse movement and possibly deformation of the terminal during the crimping process. The ram then moves in the return direction 80 to its upward limit indicated at 190 in FIG. 5 and the cycle repeated any desired number of times. The operation of the applicator 160 is substantially the same as the operation of the applicator 50, as described above and, therefore, will not be described here. It will be understood that the length L of the standoff 136, as seen in FIG. 10, is chosen to provide the desired gap 192 for a particular terminal that is being crimped in the applicator 50 and the applicator 160. Each different terminal that is to be crimped in the applicator 50 or the applicator 160 will require a corresponding standoff 136 with a specific length L.

Figure 14:
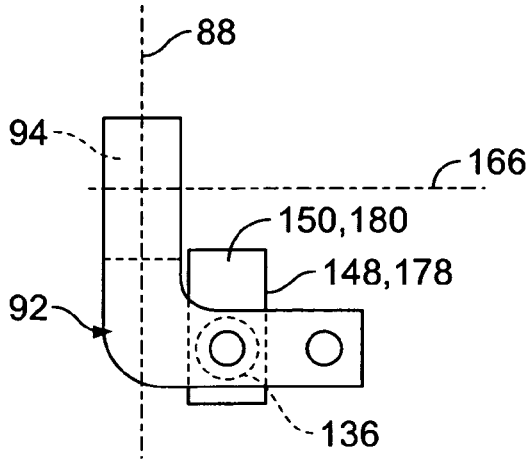
FIG. 14 is a schematic plan view of the terminal hold down device and travel limit block shown in FIG. 5.

There is shown in FIG. 14 a schematic plan view of the terminal hold down arm 92 and the travel limit block 148,178. For reference this schematic view is similar to a view looking downwardly at the hold down arm 92 in FIG. 5. As shown in FIG. 14 the feed path 88 for side feed and the feed path 166 for end feed are at a mutual right angle and intersect in the approximate center of the hold down surface 94. The standoff 136 is well offset to both feed paths 88 and 166. This offset, while not required to practice the teachings of the present invention, helps to enable the use of the same terminal hold down device 90 in both applicators arranged for side feed and applicators arranged for end feed, especially where the ram 62 is of cylindrical shape.

Figure 15:
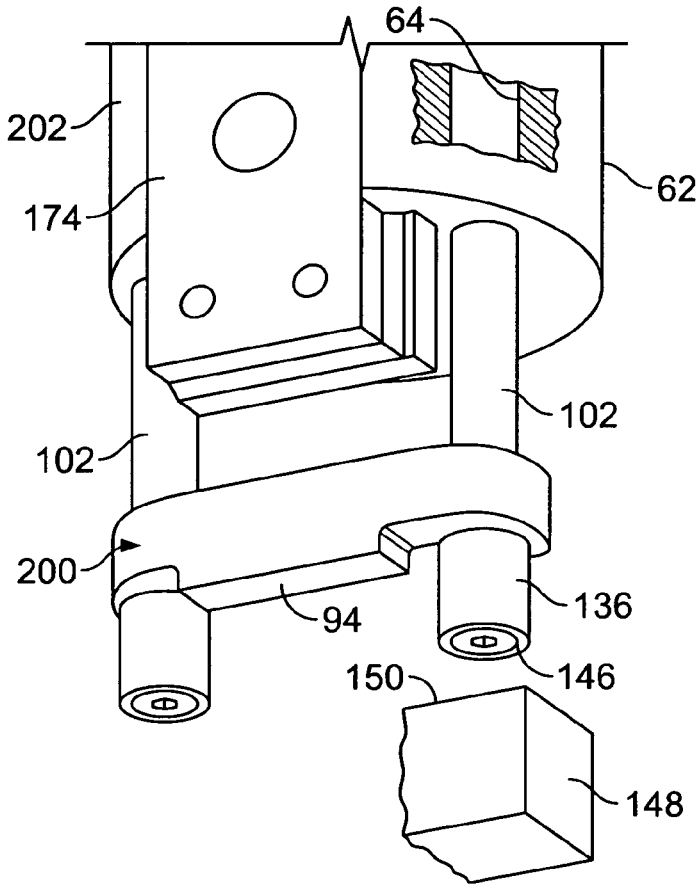
FIG. 15 is a view similar to that of FIG. 6 showing a second embodiment of the present invention.

There is shown in FIG. 15 a second embodiment of the present invention where the hold down arm 92 of the first embodiment is replaced with an elongated, somewhat rectangular, hold down arm 200 having a similar hold down surface 94. The two guide rods 102 are arranged in two holes 64 in a ram 202 in a manner similar to that of the first embodiment, including springs 114 and a keeper pin 108, not shown. In this case the two holes 64 are spaced on opposite sides of the ram 202 with the crimping tooling 174 somewhat centered therebetween. A pair of standoffs 136 are removably threaded into holes 126 in the ends of the guide rods to fix the hold down arm 200 in position. One of the standoffs 136 is in vertical alignment with the travel limit block 148 so that when the ram 200 has moved downwardly sufficiently far, the stop surface 146 abuts the abutting surface 150 thereby preventing further downward movement of the hold down arm, in a manner similar to that of the first embodiment. One of the two standoffs 136 may, optionally, be replaced with a screw 130. With the exception of the differences outlined here the structure and operation of the second embodiment is similar to that of the first embodiment.

It will be understood that the positions of the flat head screw 130 and the stud 140 may be reversed, that the guide rods 102 and their corresponding holes 100 may be of a different shape than cylindrical, and that the shape of the standoff 136 and the travel limit block 148,178 may vary, without departing from the teachings of the present invention. Additionally, the hold down arm 92 could have a substantially rectangular shape with the two guide rods 102 in somewhat alignment with the feed path 88 while adhering to the teachings of the present invention.

An important advantage of the present invention is that a given ram 62 and associated terminal hold down device 90 may be used in both the side feed applicator 50 and the end feed applicator 160 thereby reducing the number of different parts that must be purchased and stocked. The hold down device 90 is effective in limiting adverse movement and possible deformation of the terminal during the crimping process. Another important advantage is that the hold down arm 92 and guide rods 102 are used in all different terminal applications. Only the relatively simple standoff 136 with a particular length L need be manufactured to accommodate a different terminal, thereby eliminating the need to manufacture a more complex part as is required by the prior art devices. Additionally, when adjusting the crimp height the gap 192 is unaffected; unlike some prior art terminal hold down devices. When the terminal applicator is originally set up the proper standoff for the desired terminal can be quickly installed without the need for tedious, time consuming adjustments. Once the proper standoff is installed the gap 192 is less likely to go out of adjustment during operation than some prior art devices because the standoff 136 has a fixed length.

The invention claimed is:

1. A terminal applicator for attaching an electrical terminal to a conductor, said terminal applicator including: a frame having an abutting surface attached thereto; an anvil supported by said frame; a feed mechanism coupled to said frame for feeding a strip of electrical terminals along a feed path extending to said anvil and positioning an electrical terminal in crimping position on said anvil; a ram, having crimping tooling attached thereto, in sliding engagement with said frame and arranged to undergo reciprocating motion carrying said crimping tooling along an axis in a crimping direction into crimping engagement with said electrical terminal on said anvil and in an opposite return direction away from said anvil, a hold down device having a hold down surface, said device carried by said ram for moving said hold down surface into close proximity to said terminal when said crimping tooling is approaching said crimping engagement with said terminal, wherein said hold down device comprises a standoff removably attached thereto that abuts said abutting surface when said crimping tooling is approaching said crimping engagement.

2. The terminal applicator according to claim 1 wherein said hold down device is in sliding engagement with said ram, is resiliently biased in a direction along said axis toward said anvil, and includes a hold down arm having said hold down surface.

3. The terminal applicator according to claim 2 wherein said standoff is said removably attached by means of a screw thread.

4. The terminal applicator according to claim 3 wherein said screw thread is formed integral to said standoff and is received into a threaded hole in said hold down device.

5. The terminal applicator according to claim 2 wherein said sliding engagement of said hold down device with said ram is effected by at least one rod projecting from said hold down device and slidingly engaged in a guide in said ram.

6. The terminal applicator according to claim 5 wherein said at least one rod is two rods mutually parallel engaging two corresponding guides in said ram.

7. The terminal applicator according to claim 6 wherein said two guides are two holes bored in said ram substantially parallel to said axis and said two rods are cylinder shaped, each being in sliding engagement with a respective one of said two holes.

8. The terminal applicator according to claim 6 wherein said resilient bias of said hold down device is effected by a spring in one of said two holes.

9. The terminal applicator according to claim 1 wherein said hold down device, is interchangeably functional in both a said applicator arranged for side feeding of said terminal and a said applicator arranged for end feeding of said terminal.

10. The terminal applicator according to claim 9 wherein said standoff is adjacent said hold down surface and offset with respect to said feed path of both said end feed and said side feed.

11. A hold down device operational in at least one of an applicator arranged for side feed and an applicator arranged for end feed, both said applicators being arranged for crimping an electrical terminal to a conductor, each of said applicators including: a frame having an abutting surface attached thereto; an anvil supported by said frame and arranged to receive an electrical terminal; a ram, having crimping tooling attached thereto, in sliding engagement with said frame and arranged to undergo reciprocating motion carrying said crimping tooling along an axis in a crimping direction into crimping engagement with said electrical terminal on said anvil and in an opposite return direction away from said anvil; said crimping tooling arranged to effect said crimping in cooperation with said anvil, comprising:

a hold down surface is carried by said ram for moving said hold down surface into close proximity to said terminal when said crimping tooling is approaching said crimping engagement with said terminal, wherein said hold down device is in sliding engagement with said ram to adjust a relative height of said hold down surface with respect to said ram, and a standoff coupled to said ram for engaging said abutting surface when said crimping tooling is approaching said crimping engagement.

12. The hold down device according to claim 11 wherein said standoff is attached to said hold down device.

13. The hold down device according to claim 12 wherein said standoff is removably attached to said hold down device.

14. The hold down device according to claim 13 wherein said hold down device is resiliently biased in a direction along said axis toward said anvil, and includes a hold down arm having said hold down surface.

15. The hold down device according to claim 14 wherein said standoff is removably attached by means of a screw thread.

16. The hold down device according to claim 15 wherein said screw thread is formed integral to said standoff and is received into a threaded hole in said hold down device.

17. The hold down device according to claim 16 wherein said sliding engagement of said hold down device with said ram is effected by at least one rod projecting from said hold down device and slidingly engaged in a guide in said ram.

18. The hold down device according to claim 17 wherein said at least one rod is two rods mutually parallel engaging two corresponding guides in said ram.

19. The hold down device according to claim 18 wherein said two guides are two holes bored in said ram substantially parallel to said axis and said two rods are cylinder shaped, each being in sliding engagement with a respective one of said two holes.

20. A terminal applicator for attaching an electrical terminal to a conductor, said terminal applicator including:

(1 ) a frame having an anvil and an abutting surface adjacent thereto;

(2 ) a ram arranged for reciprocating motion within said frame along an axis toward and away from said anvil;

(3 ) crimping tooling carried by said ram so that during said reciprocating motion said crimping tooling moves into engagement with a terminal in position on said anvil, continuing movement of said ram crimps said terminal, and then said crimping tooling moves away therefrom; and (4 ) a hold down device carried by said ram for moving into close proximity to said terminal when said crimping tooling is in said engagement with said terminal in position on said anvil, wherein said hold down device includes a standoff removably attached thereto that abuts said abutting surface thereby preventing forceful contact between said hold down device and said terminal and minimizing adverse movement and deformation of said terminal during said engagement of said crimping tooling with said terminal and said crimping thereof.

* * * * *